US006159278A

United States Patent [19]

Nemegeer et al.

[11] Patent Number: 6,159,278

[45] Date of Patent: Dec. 12, 2000

[54] PREPARATION OF BITUMINOUS CONCRETE COMPRISING WIRE PIECES

[75] Inventors: Dirk Nemegeer, Harelbeke; Yves Vancraeynest, Zwevegem, both of Belgium

[73] Assignee: N.V. Bekaert S. A., Zwevegem, Belgium

[21] Appl. No.: 07/860,523

[22] Filed: Apr. 1, 1992

Related U.S. Application Data

[63] Continuation of application No. 07/523,524, May 15, 1990, abandoned.

[30] Foreign Application Priority Data

May 16, 1989 [NL] Netherlands ..... 8901216

[51] Int. Cl.[7] ..... C09D 195/00

[52] U.S. Cl. ..... 106/282

[58] Field of Search ..... 106/277, 282

[56] References Cited

U.S. PATENT DOCUMENTS

| | | | |
|---|---|---|---|
| 4,284,667 | 8/1981 | Moens | 427/331 |
| 4,314,853 | 2/1982 | Moens | 106/99 |
| 4,360,473 | 11/1982 | Marzocchi et al. | 260/429.5 |
| 4,382,988 | 5/1983 | Gallman | 428/222 |
| 5,028,266 | 7/1991 | Rettenmaier et al. | 106/282 |

OTHER PUBLICATIONS

Joseph, *CHE 477, Process Technology Lecture Notes,* Washington Univ., School of Engineering and Applied Science, Aug. 1986, p. 3.5.

*Primary Examiner*—David Brunsman
*Attorney, Agent, or Firm*—Foley & Lardner

[57] ABSTRACT

The invention relates to the manufacturing of a castable hot mixture of bituminous concrete, in which a multiplicity of steel wire pieces are equally distributed in the mixture. According to the invention, an ingredient is used in the form of a multiplicity of bundles in which the wire pieces are held together by a binding substance that is able to disintegrate in cementitious concrete, as already known, but that in addition is disintegrated by melting, in such a way that such bundles are usable for both cementitious and bituminous concretes.

6 Claims, No Drawings

PREPARATION OF BITUMINOUS CONCRETE COMPRISING WIRE PIECES

This application is a continuation of application Ser. No. 07/523,524, filed May 15, 1990 now abandoned.

BACKGROUND OF THE INVENTION

The invention relates to a process for the preparation of a castable hot mixture of bituminous concrete. Such concrete is often used for strengthening the banks of waterways and for roadway surfaces. As is well known, it comprises a mixture of filling material (such as sand, lime, and/or stone pieces e.g. of dimension from 2 mm up to 20 mm) and a fusible bitumen that, in a hardened state, binds the filling material together. "Bitumen" is to be understood as a mixture of mainly hydrocarbons with residual impurities, as obtained as residues from refining coal or petroleum, such as pitch or tar or asphalt. The chosen bitumen is adapted to be sufficiently hard for the temperatures at which it is exposed for use, which in general is a temperature below 40 C., and further adapted to be sufficient liquid at the mixing temperature, so as to be mixable with the filling material during mixing, and to keep sufficiently soft during a subsequent time after dumping, so that it can be deformed and compacted into its final form in which it has to harden. A suitable mixing temperature ranges between 80° C. and 200° C. Mixing below 80° C. leaves insufficient free time between dumping and compacting, and above 200° C. the process is less economical and less practical for handling the hot mixture. A mixture of such bituminous concrete at such mixing temperature is meant when referring hereinafter to a "castable hot mixture of bituminous concrete".

In order to strengthen the bituminous concrete, it is known, e.g. from U.S. Pat. No. 4,382,988, to introduce into the mixture a multiplicity of steel wire pieces, adapted for strengthening the bituminous concrete after its solidification, and mixing the steel wire pieces into the mixture. There are already steel wire elements on the market, adapted for reinforcement of cementitious concrete, in the form of bundles of such steel wire pieces that are held together in the bundles by a binding substance adapted to disintegrate by water when mixed into a wet cementitious concrete. Such wire bundles are introduced into the wet mixture of cementitious concrete, they disintegrate into individual wire pieces by the water of the mixture and by the mixing movement, and, by further mixing, the individual wire pieces come to be equally distributed in the mixture. Owing to the introduction in the form of bundles, it is avoided that the individual wires come to conglomerate into balls instead of being equally distributed. Such a mixing method and a bundle adapted has for this method been described in U.S. Pat. No. 4.314.853. Such bundles are now produced in mass by a method in which a number of wires are bundled and then glued together by applying a water emulsion of the glue (that, after drying, will re-emulgate or dissolve later again in the cementitious concrete) and then the bundles are caused to dry in a drying furnace. Then bundle is then finally transversally cut into pieces of short bundles, as described in U.S. Pat. No. 4.284.667. A known glue for that use is a glue of about 75% polyvinyl-acetate dispersion with a softening agent and with about 25% of a glue that is soluble in water, such as polyvinylalcohol or ethylene-vinyl acetate.

OBJECTS AND SUMMARY OF THE INVENTION

In adapting this mixing method with bundles of wire pieces to bituminous concrete, it has been found that the same wire bundles on the market for use in cementitious concrete can be directly usable for bituminous concrete, notwithstanding the fact that a mixture of the latter does not comprise any water, because the binding substance, that keeps the wire pieces together, is, or can be made adapted also to melt at the mixing temperature of the bituminous concrete and to cause the bundles to disintegrate. When such fiber bundles are chosen for bituminous concrete, it is not necessary to keep a separate stock for cementitious and for bituminous concrete.

The invention is consequently characterized by the fact that the steel wire pieces are introduced into a mixture for such bituminous concrete in the form of bundles of such steel wire pieces that are held together into the bundles by a binding substance adapted to disintegrate by water when mixed into a cementitious concrete, the bundles being also adapted to disintegrate by melting when mixed in the hot bituminous concrete mixture, and that the bundles are caused to disintegrate during mixing of said bituminous concrete. By "adapted to disintegrate by melting" is meant here that the binding substance, when mixed into the castable hot mixture of bituminous concrete, loses sufficient solidity to allow the bundles of wire pieces to disintegrate into individual wire pieces under the mixing movement, where this loss of solidity is due to the substance passing wholly or partially from the solid to the molten state. The loss of solidity does not necessarily occur at a sharply defined melting point. For substances that are composed of different molecules with different melting points, as e.g. for synthetic resins, the loss of solidity occurs by gradually softening through a softening temperature range. For these substances, the temperature level of softening is determined here by the softening point according to the Ring & Ball test. And for the substances with sharply defined melting point, the "softening" occurs at the melting temperature. This is what is meant here by "softening point".

DETAILED DESCRIPTION OF THE PREFERRED EMBODIMENT

It is advisable to use a mixing temperature that lies in a range between 30 and 50 degrees centigrade above the softening point of the binding substance of the bundles. If the mixing temperature lies too high above that softening point, then it will be observed that the binding substance melts too rapidly before the undisintegrated bundles are firstly equally distributed into the mixture, and when the mixing temperature lies too near above the softening point, then there is a risk that the bundles are not completely disintegrated. As the suitable mixing temperature ranges between 80° C. and 200° C., and as a softening point below 50° C. is undesirable in order to avoid that the bundles begin to stick to each other when exposed to the sun or to warm climate circumstances,this means that the softening point for the binder will lie in the range between 50° C. and 170° C.

In order to come into consideration for the strengthening of the hardened bituminous concrete, the steel wire pieces shall have an essentially oblong form, with a thickness of 0.3 to 1.5 mm, a length-to-thickness ratio between 40 and 120 and a maximal length of 120 mm. By "oblong" is meant, that the wire piece is not so bent or curled, that it would no longer be possible to distinguish a general length direction in which the wire piece has to exert its strengthening effect. In this respect, the apparent length of the wire piece, i.e. the distance between both ends of the wire piece, has not to be smaller than 0.7 times the length, as measured along the wire piece. The thickness of the wire piece, for non-circular cross sections, is calculated as the diameter of the circle having the same area.

A bundle then comprises a number of such wire pieces, preferably between 5 and 40. These wire pieces are then held together by the binding substance, not necessarily by the fact that the wire pieces are glued to each other, where the binding substance is located between the wire pieces, but e.g. also by the fact that the binding substance is located around the bundle, in the form of a tight sleeve around the bundle, or one or more tight rings, or one or more wrapping filaments. The bundle need not necessarily be a bundle with round cross-section, but shall preferably be a flat bundle of wires that are glued together side by side. Such bundles are easier for disintegration during mixing.

For the intended double possibility of use, the binding substance, disintegratable by melting, has also to be disintegratable in the water of cementitious concrete. This can be obtained by using a substance that is completely dissoluble in water, as well as by using a composition that is only partially dissoluble, in such a way that the non-dissoluble part sufficiently softens and/or emulgates for allowing the steel wire pieces to be separated by the mixing movement. Preferably, an adhesive on the basis of polyacetate, as mentioned above is used. If an ethylene-vinylacetate is added as the water soluble component, the softening point can be adapted by changing the ethylene/vinylacetate ratio.

The binding substance can be a polymer or copolymer that is soluble in water, preferably in the form of a conventional hot melt adhesive, which comprises additional resins, waxes, softeners, stabilizers and possible filler substance. Suitable hot melt adhesives are those that are used for applying in molten state on paper or cardboard, and intended to be tacky again by moistening with water, such as those that are obtainable on the market, and, for instance described in the book of D.L. Bateman, "Hot Melt Adhesives", Third Edition, Noyes Data Corporation.

In use, the bundles of steel wire pieces are dumped in bulk into the mixture. They can be added first and mixed into a dry mixture, before adding the bitumen, and the latter can then be added thereafter. The bundles can also be added to the hot mixture that already contains the molten bitumen. In each of these cases, the bundles themselves will firstly be equally distributed in the mixture under influence of the mixing movement. And afterwards, still during further mixing, the binding substance will soften and/or melt, whereby the bundles break open into separate wire pieces that are further mixed and come to be equally distributed as separate wire pieces.

We claim:

1. A process for preparing a castable hot mixture of bituminous concrete, comprising the steps of:

introducing into a mixture of hot bituminous concrete a multiplicity of steel wire pieces adapted for strengthening said mixture of hot bituminous concrete after its solidification; and mixing said steel wire pieces in said mixture of hot bituminous concrete until said steel wire pieces are equally distributed in said mixture of hot bituminous concrete, wherein said steel wire pieces are introduced in the form of bundles of such steel wire pieces that are held together into said bundles by a binding substance which is adapted to disintegrate by water when mixed into a wet cementitious concrete and which disintegrates by melting when mixed in a hot bituminous concrete mixture, and wherein said steel bundles disintegrate during mixing of said mixture of hot bituminous concrete.

2. A process as recited in claim 1, wherein the steel wire pieces which are introduced into said mixture of hot bituminous concrete are stiff.

3. A process as recited in claim 2, wherein the steel wire pieces which are introduced into said mixture of hot bituminous concrete have a thickness between 0.3 to 1.5mm and a length to thickness ratio of between 40 and 120.

4. A process according to claim 1, wherein a mixing temperature of said mixture of hot bituminous concrete lies in the range between 80° C and 200° C., and in a range between 30 and 50 centigrade degrees above a softening point temperature of said binding substance.

5. A process according to claim 1 wherein said bundles are dumped in bulk into said mixture.

6. A process for preparing a castable hot mixture of bituminous concrete, comprising the steps of:

introducing into a mixture of hot bituminous concrete a multiplicity of steel wire pieces adapted for strengthening said mixture of hot bituminous concrete after its solidification; and mixing said steel wire pieces in said mixture of hot bituminous concrete at a temperature of between 80° C and 200° C. until said steel wire pieces are equally distributed in said mixture of hot bituminous concrete, wherein said steel wire pieces are introduced in the form of bundles of such steel wire pieces that are held together into said bundles by a binding substance which is adapted to disintegrate by water when mixed into a wet cementitious concrete and which disintegrates by melting when mixed in a hot bituminous concrete mixture, and wherein said steel bundles disintegrate during mixing of said mixture of hot bituminous concrete.

* * * * *